US008158934B2

(12) United States Patent
Wells

(10) Patent No.: US 8,158,934 B2
(45) Date of Patent: Apr. 17, 2012

(54) ELECTRON CAPTURE DISSOCIATION APPARATUS AND RELATED METHODS

(75) Inventor: Gregory J. Wells, Fairfield, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 214 days.

(21) Appl. No.: 12/547,358

(22) Filed: Aug. 25, 2009

(65) Prior Publication Data

US 2011/0049347 A1 Mar. 3, 2011

(51) Int. Cl.
*H01J 49/26* (2006.01)

(52) U.S. Cl. ..... 250/288; 250/282; 250/281

(58) Field of Classification Search ..... 250/281–282, 250/288
See application file for complete search history.

(56) References Cited

U.S. PATENT DOCUMENTS

| | | | | |
|---|---|---|---|---|
| 3,896,331 | A * | 7/1975 | Enck et al. | 315/17 |
| 6,653,622 | B2 | 11/2003 | Franzen | |
| 6,800,851 | B1 | 10/2004 | Zubarev et al. | |
| 6,858,840 | B2 * | 2/2005 | Berkout et al. | 250/282 |
| 6,919,562 | B1 | 7/2005 | Whitehouse et al. | |
| 6,924,478 | B1 | 8/2005 | Zubarev et al. | |
| 6,995,366 | B2 | 2/2006 | Franzen | |
| 7,026,613 | B2 | 4/2006 | Syka | |
| 7,030,374 | B2 | 4/2006 | Franzen | |
| 7,049,584 | B1 * | 5/2006 | Whitehouse et al. | 250/288 |
| 7,145,139 | B2 | 12/2006 | Syka | |
| 7,227,133 | B2 | 6/2007 | Glish et al. | |
| 7,309,860 | B2 * | 12/2007 | Baba et al. | 250/288 |
| 7,755,034 | B2 * | 7/2010 | Ding | 250/282 |
| 7,800,058 | B2 * | 9/2010 | Sugiyama et al. | 250/282 |
| 2005/0017167 | A1 * | 1/2005 | Franzen | 250/288 |
| 2006/0219896 | A1 | 10/2006 | Hashimoto et al. | |
| 2007/0085000 | A1 * | 4/2007 | Furuhashi et al. | 250/288 |

FOREIGN PATENT DOCUMENTS

| | | |
|---|---|---|
| JP | 2004-158360 A | 6/2004 |
| JP | 2007-033322 A | 2/2007 |

OTHER PUBLICATIONS

Sadat, et al., International Journal of Mass Spectrometry, 107, (1991) 191-203.
Zerega, et al., International Journal of Mass Spectrometry, 132 (1994) 57-65.
Zerega, et al., International Journal of Mass Spectrometry, 132 (1994) 67-72.
Zerega, et al., International Journal of Mass Spectrometry, 135 (1994) 155-164.
Zuberev, et al., Chemical Physics Letters, 356 (2002) 201-206.
International Search Report and Written Opinion From Corresponding PCT Application No. PCT/US2010/046201, Apr. 20, 2011 (8 pgs).

* cited by examiner

*Primary Examiner* — Jack Berman
*Assistant Examiner* — Wyatt Stoffa

(57) ABSTRACT

An electron capture dissociation apparatus comprises ion guide electrodes, an electron emitter, and an electron control device. The ion guide electrodes are arranged along a central axis and spaced circumferentially to circumscribe an interior space extending along the central axis. The electron emitter is disposed outside the interior space. The electron control device is configured for focusing an electron beam from the electron emitter toward the central axis, along a radial electron beam direction between two of the ion guide electrodes, and for decelerating the electron beam in a DC decelerating field of adjustable voltage potential directed along the electron beam direction.

20 Claims, 6 Drawing Sheets

ELECTRON CAPTURE DISSOCIATION APPARATUS AND RELATED METHODS

FIELD OF THE INVENTION

The present invention relates generally to fragmenting ions by electron capture dissociation, particularly in an ion trap driven by electric fields without magnetic fields.

BACKGROUND OF THE INVENTION

An ion trap is commonly utilized in a mass spectrometer (MS) as a means for controlling and spatially confining the motions of ions for various purposes. The theory, design and operation of various types of ion traps and associated mass spectrometers are well-known to persons skilled in the art and thus need not be detailed in the present disclosure. One common class of ion traps is the Penning trap, or ion cyclotron resonance (ICR) cell, marketed commercially as a Fourier Transform Mass Spectrometer (FTMS). The Penning trap uses an arrangement of electrodes to apply fixed magnetic and electric fields to confine ions in the radial and axial directions, respectively. An alternating electric field is used to resonantly excite the ions for determination of their mass-to-charge (m/z) ratios. Another common class of ion traps is the Paul or RF (radio frequency) trap, in which alternating electric field gradients are used to confine the ions. The Paul trap may have a three-dimensional (3D) configuration formed by a ring electrode and two opposing end-cap electrodes. An RF trapping field applied to the ring and end caps of the 3D trap confines the ions in both the radial and axial directions. The Paul trap may alternatively have a two-dimensional (2D) configuration formed by a multipole arrangement of parallel electrodes extending in the axial direction and end electrodes positioned at the opposing axial ends of the multipole electrode set. An RF trapping field applied to the multipole electrode set confines the ions in the transverse direction, and DC potentials applied to the end electrodes confine the ions in the axial direction. In Paul traps, the RF trapping field is modulated, or alternatively a supplemental AC resonant excitation field is added, to manipulate the ions for determination of their m/z ratios.

In conjunction with processes such as tandem MS (MS/MS), ion traps may be used to dissociate (fragment) ions into smaller ions to enhance structural elucidation and identification of the molecules that were ionized for investigation. The mechanism for dissociation usually performed in Paul traps is collision-induced dissociation (CID), also referred to as collision-activated dissociation (CAD). CID entails accelerating a parent ion to a high kinetic energy in the presence of a background neutral gas (or collision gas) such as helium, nitrogen or argon. When the excited parent ion collides with the gas molecule, some of the parent ion's kinetic energy is converted into internal (vibrational) energy. If the internal energy is increased high enough, the parent ion will break into one or more product (or fragment) ions, which may then be mass-analyzed. A similar mechanism is employed in Penning traps, known as sustained off-resonance irradiation (SORI) CID, which entails accelerating the ions so as to increase their radius of cyclotron motion in the presence of a collision gas. An alternative to CID and SORI-CID is infrared multiphoton dissociation (IRMPD), which entails using an IR laser to irradiate the parent ions whereby they absorb IR photons until they dissociate into fragments ions. IRMPD is also based on vibrational excitation (VE).

CID and IRMPD are not considered to be optimal techniques for dissociating ions of large molecules such as high molecular-weight or long-chain biopolymers (e.g., peptides, proteins, etc.). For many types of large molecules these VE-based techniques are not able to cause the types of bond cleavages, or a sufficient number of these cleavages, so as to yield a complete structural analysis. Currently, electron capture dissociation (ECD) is being researched as a promising new method for dissociating large molecular ions. In ECD, the well-known technique of electrospray ionization (ESI) is usually selected to form multiply-charged ions of large molecules by proton attachment. The "soft" or "gentle" technique of ESI leaves the multiply-charged ions intact, i.e., not fragmented. The ions are then irradiated by a stream of low-energy electrons. If their energy is low enough, the electrons can be captured by the positively charged sites on the ions. The energy released in the exoergic capture process is released as internal energy in the ion which can then cause bond cleavage and dissociation. Typically, ECD occurs at electron energies less than 3 eV. In addition, "hot" ECD (HECD) may be implemented at higher electron energies (typically 3-13 eV) in which electron excitation precedes capture. With HECD the resulting fragments may undergo secondary fragmentation, which can provide analytical advantages for experiments carried out on many types of molecular ions. For example, HECD allows for distinguishing between isomeric leucine and isoleucine residues. See Zuberev et al., Chemical Physics Letters, 356 (2002) 201-206. For purposes of the present disclosure, the term ECD also encompasses HECD unless specified otherwise.

Thus far, ECD has been investigated mainly in the context of Penning trap-based instruments as the magnetic field facilitates stable control over the electrons. Penning trap-based instruments such as FTMS, however, are not in widespread use because of their high cost and technical complexity. On the other hand, the implementation of ECD in Paul traps and multipole RF storage cells is challenging. These RF-based instruments operate without a magnetic field to provide stability for the electrons. Moreover, due to their use of strong electrical fields, RF instruments deflect electrons and cause electron energies to be increased far above the 20-eV upper limit below which electron capture can take place. At these higher energies, parasitic ion formation by electron impact (EI) results in unwanted ions that contribute to the background signal and additional undesired ion-molecule reactions.

The source of electrons typically proposed for ECD is a device that includes a heated cathode capable of thermionic emission and lenses for guiding the liberated electrons as a beam into the ion trap. This type of device is commonly used in conjunction with EI ionization and other processes requiring the production of an electron beam. However, the simple lens system typically employed in such electron sources does not meet the requirements of ECD. Optimized control of the electron beam for ECD is critical because while high energy levels are needed to remove electrons from the thermionic emitting surface, low energy levels are needed for ECD to successfully occur as noted above. Moreover, a high density of low-energy electrons must reach the region where the target ions are confined to produce a sufficient amount of fragment ions.

More specifically, it is known that the electron flux leaving a heated surface increases with the temperature of the surface. It is further known that intense beams of electrons are subject to a maximum flux that is limited by the space charge associated with electrons in the region of the surface. Due to the space charge, increasing the surface temperature will not further increase the electron flux. The space charge limit of electron flux is related to the potential difference of the emitting surface and the surrounding surfaces. This phenomenon is described by the well-known Child-Langmuir space-charge law in which the current density, J, varies as the 3/2 power of the voltage potential according to the relation $J=KV^{3/2}$, where K is a known constant. The importance of this is that to form intense beams of electrons from a heated surface it is necessary to employ a large extraction voltage. However, the large extraction voltage produces high energy electrons that are not suitable for ECD. Therefore, means must be employed for slowing down the electrons before they encounter the target ions. An additional problem associated with the formation of intense beams of electrons is the undesired beam divergence that occurs when electrons are decelerated. This can be described by the Law of Helmholz-Lagrange (equivalent to the Abby Sine Law in light optics). A summary of this law is that the product of the lateral magnification, the angular magnification, and the ratio of the final and initial indices of refraction (equal to the square root of the potential for charged particle optics) is equal to unity. This is a statement of Liouville's theorem in statistical mechanics which states that the volume of phase space in non-dissipative systems (collision-free conditions) is conserved. Applying these principles to the context of ECD, consider the case where high accelerating potentials are utilized to produce intense electron fluxes from a heated surface with a beam of small angular divergence. If a simple lens system of two different potentials is utilized to control the electron beam, it follows that a large angular divergence will result when the beam is decelerated in the second lower potential region in an attempt to reduce the electron energy down to the levels required for ECD. If too much spatial spreading of the electron beam is permitted at the location of the target ions, there is no assurance that the electrons will have a low enough energy for ECD and the density (or intensity) of the electron beam at this point may be unacceptably low for producing an abundance of fragment ions. Therefore, a conventional lens system is not effective for appropriately shaping the electron beam so that low-energy electrons can be delivered into the trapping region with the desired properties.

Delivering electrons into an RF trapping region is further complicated by the effect that the RF fields have on the motion and energy of electrons. The RF voltage signal typically applied to the ion trap electrodes to confine the ions has a basic sine wave shape. Thus, over most of the RF cycle the magnitude of the voltage is a relatively large positive or negative value such that the ion trap electrodes will deflect electrons away from their intended path by attraction or repulsion. The sinusoidal waveform provides only a very short window of time, where the signal crosses zero volts, in which an electron beam may be successfully directed into the trap without being perturbed by the RF trapping field. Thus, for many applications it would be better to utilize rectangular impulses or other periodic waveforms that provide longer periods of zero RF voltage during which electrons may enter the trapping region, yet are still effective for trapping ions. Impulse-driven RF trapping for electron capture has been studied extensively by Zerega et al., International Journal of Mass Spectrometry, 132 (1994) 57-65, 67-72, and 135 (1994) 155-164; and by Sadat et al., International Journal of Mass Spectrometry, 107 (1991) 191-203. The latter has proposed the use of a particular form of impulse of the type $V(t)=\cos(\Omega t)/(1-k\cos(2\Omega)$, where k=0.5-0.99. A wave form of this type was shown to have a stability region very similar to that of a quadrupole trapping field, but with the advantage that about 50% of time the RF voltage is near zero, thus making it ideal for low energy electron attachment studies.

For many applications, it would also be desirable to increase the internal energy of the target ions so as to change the way fragmentation occurs when the target ions undergo ECD or HECD, and to provide fragment ion information complementary to that obtained by ECD or HECD alone. One way of increasing ion internal energy is to increase ion kinetic energy and allow the accelerated ions to collide with a light collision gas such as helium, similar to the CID techniques described above but without dissociation. However, conventional techniques for increasing ion kinetic energy are difficult to implement in conjunction with ECD. In an RF quadrupole ion trap, ion kinetic energy may be increased by applying a supplemental AC field to an opposing set of electrodes at a frequency that matches the secular frequency of the ion in the trapping field. This means of increasing the kinetic energy thus requires the supplemental field to be in resonance with the ion motion. Moreover, the transverse oscillatory motion also periodically displaces the ions away from the central axis or region where ECD is to occur, and therefore causes the ions to be located at a distribution of electron kinetic energies because this kinetic energy varies in the transverse direction. In a Penning trap, the SORI operation also increases ion kinetic energy. But similar to the resonance condition required by an RF trap for ion excitation, SORI while off-resonance nonetheless requires the use of precise frequencies. Moreover, with SORI the radius of the cyclotron motion of the ion increases and the ions move away from the central axis of the detector cell. It is along the central axis that the low-energy electrons are located due to the effect of the magnetic field. Therefore, while SORI will produce an increase in internal energy due to ion-molecule collisions, the ions will not be located so as to react with the electrons in the trapping cell.

Accordingly, there is a need for apparatus and methods for implementing electron capture dissociation effectively and efficiently in RF confining devices that do not rely on the use of magnetic fields. There is also a need for apparatus and methods capable of selectively implementing either ECD or HECD as desired for a given analysis. There is also a need for apparatus and methods for delivering high fluxes of electrons at very low energies in the ranges required for ECD or HECD to a specific area in an instrument where target ions to be dissociated are trapped. There is also a need for apparatus and methods that provide an electron beam optimized for either ECD or HECD as needed, and optimized for a broad mass range of target ions. There is also a need for apparatus and methods for increasing the internal energy of target ions as a means for enhancing, or modifying the fragmentation pathways provided by, ECD or HECD.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an electron capture dissociation apparatus includes a first axial end, a second axial end disposed at a distance from the first axial end along a central axis, a plurality of ion guide electrodes, an electron emitter, and an electron control device. The ion guide electrodes are arranged along the central axis from the first axial end to the second axial end, spaced circumferentially from each other about the central axis and disposed at a radial distance in a transverse plane orthogonal to the central axis, wherein the ion guide electrodes circumscribe an ion guide interior space extending along the central axis from the first axial end to the second axial end. The electron emitter is disposed outside the ion guide interior space. The electron control device is configured for focusing an electron beam from the electron emitter toward the central axis, along a radial electron beam direction between two of the ion guide electrodes, and for decelerating the electron beam in a DC decelerating field of adjustable voltage potential directed along the electron beam direction.

According to another implementation, the ion guide electrodes have an ion guide electrode length extending from the first axial end to the second axial end. The electron emitter may include a composite structure extending along the central axis over a majority of the ion guide electrode length. The composite structure may include an electrically conductive wire, an electrically insulating layer surrounding the wire, an electrically conductive layer surrounding the electrically insulating layer, and an electron emitting surface surrounding the electrically conductive layer. A heater power supply may communicate with the wire. A DC voltage source may communicate with the electrically conductive layer.

According to another implementation, a method is provided for fragmenting a parent ion into a product ion by electron capture dissociation in a linear multipole ion guide. An RF trapping voltage is applied to a plurality of ion guide electrodes of the ion guide. The ion guide electrodes are arranged along a central axis from a first axial end to a second axial end and circumscribe an ion guide interior space, wherein applying the RF trapping voltage confines the parent ion to an ion trapping region located along the central axis. An electron beam is directed from an electron emitter outside the ion guide to the ion trapping region along an electron beam direction that is radial to the central axis and passes through a gap between two adjacent ion guide electrodes. Electrons of the electron beam are decelerated by applying a DC decelerating field between a point outside the ion guide interior space to a point inside the interior space and oriented along the electron beam direction, wherein the electrons reach the ion trapping region at a reduced electron energy sufficient for electron capture by the parent ion to occur.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The subject matter disclosed herein generally relates to fragmenting ions by electron capture dissociation (ECD) and hot electron capture dissociation (HECD), and associated ion processing. Examples of implementations of methods and related devices, apparatus, and/or systems are described in more detail below with reference to FIGS. 1-11. These examples are described at least in part in the context of mass spectrometry (MS). However, any process that involves ion fragmentation may fall within the scope of this disclosure.

Figure 1:
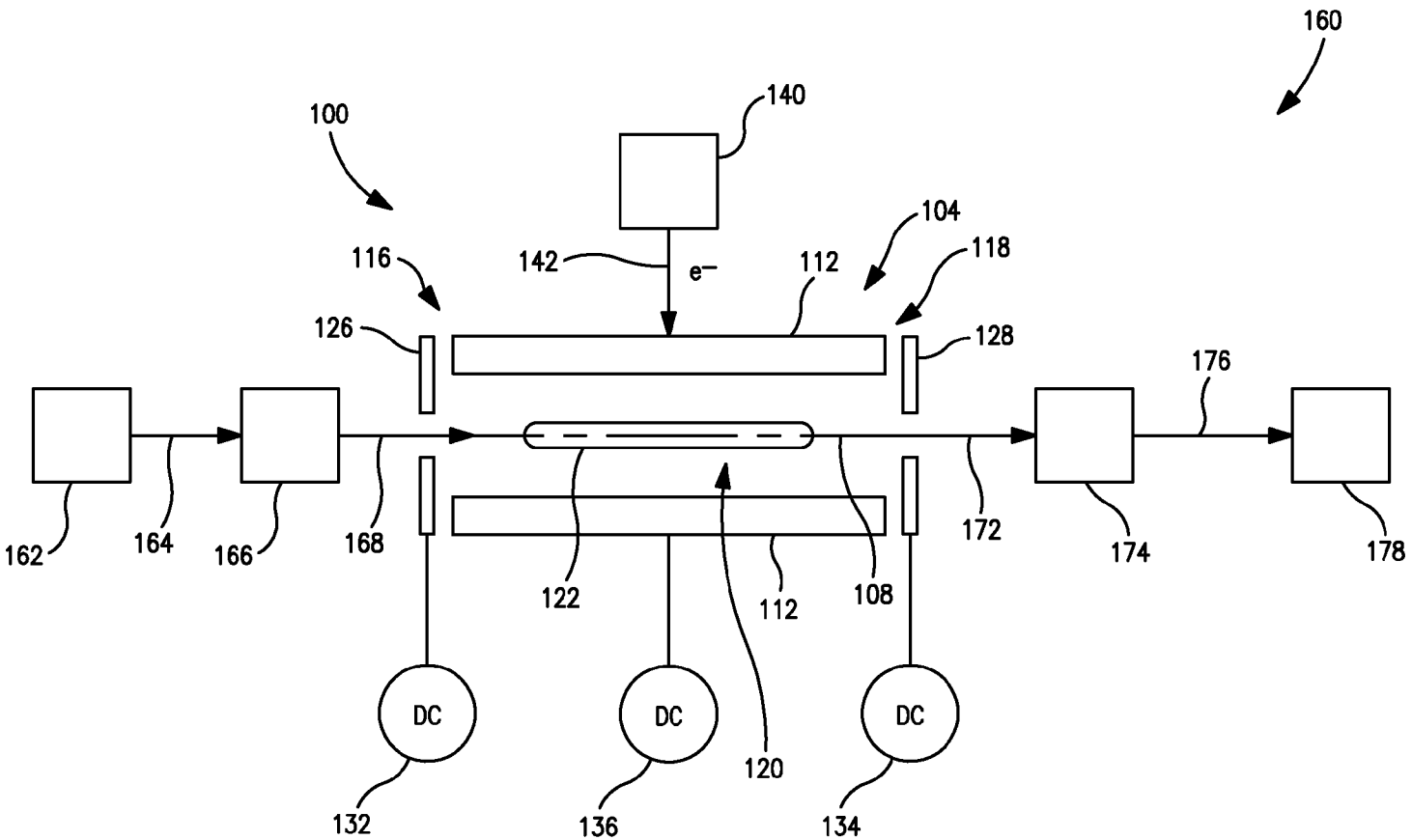
FIG. 1 is a schematic side (lengthwise) view of an example of an electron capture dissociation (ECD) apparatus according to certain implementations of the present disclosure.
Figure 3:
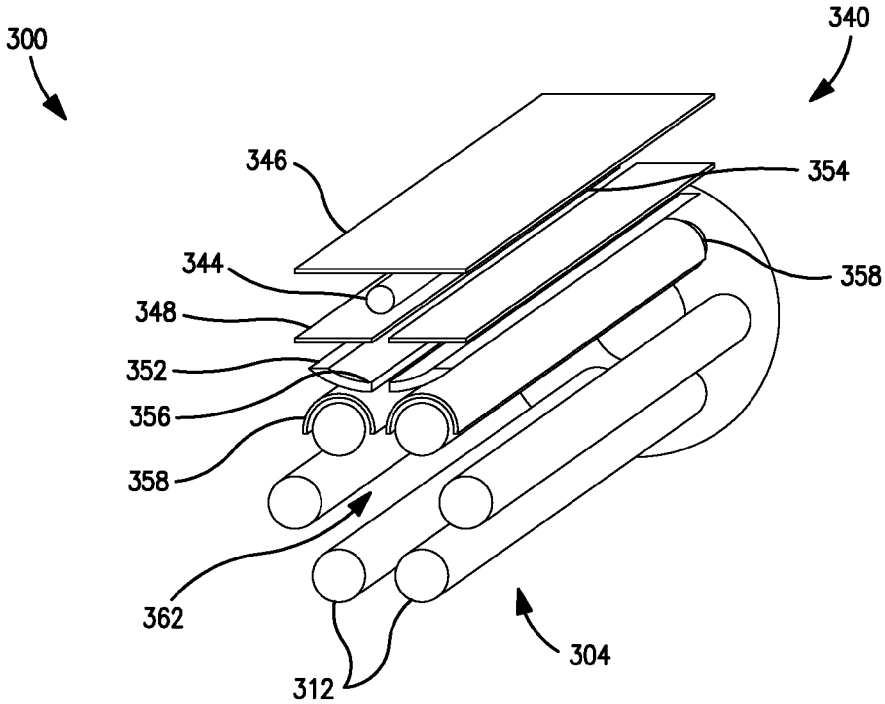
FIG. 3 is a perspective view of another example of an ECD apparatus provided in accordance with the present disclosure.
Figure 4:
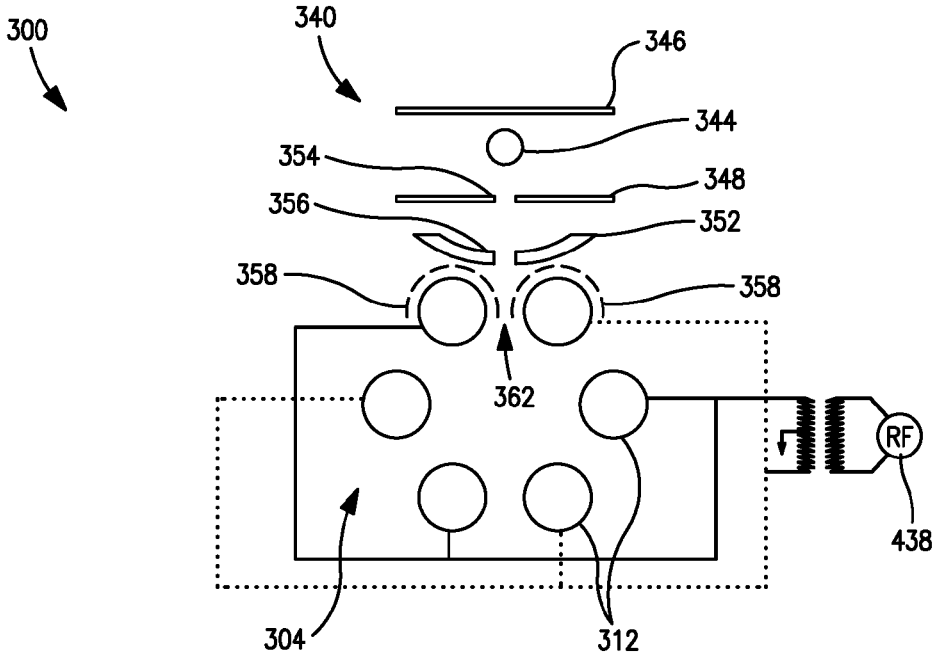
FIG. 4 is a cross-sectional view of the ECD apparatus illustrated in FIG. 3, in the transverse plane perpendicular to the central axis.

FIG. 1 is a schematic view of an example of an electron capture dissociation (ECD) apparatus 100 according to certain implementations of the present disclosure. The ECD apparatus 100 includes a linear (2D) multipole ion guide 104 arranged about a central axis 108. The ion guide 104 includes a plurality of ion guide electrodes 112 extending between a first axial end 116 and an opposing second axial end 118. For clarity, only two ion guide electrodes 112 are shown. The ion guide 104 typically includes four or more ion guide electrodes 112 coaxially arranged about the central axis 108 at a radial distance therefrom. For purposes of the present disclosure, the term "radial" indicates a direction orthogonal to the central axis 108. The ion guide electrodes 112 are circumferentially spaced from each other in a transverse plane orthogonal to the central axis 108 (FIGS. 3 and 4). In a typical linear electrode set, the number of ion guide electrodes 112 may be four (quadrupole), six (hexapole), or eight (octopole), but may be greater. The ion guide 104 may generally include a housing or frame (not shown) or any other structure suitable for supporting the ion guide electrodes 112 in a fixed arrangement relative to the central axis 108, and for providing an evacuated, low-pressure environment suitable for trapping ions using radio frequency (RF) energy. The ion guide electrodes 112 circumscribe an interior space 120 (ion trapping region) that likewise extends along the central axis 108 from the first axial end 116 to the second axial end 118. By applying an appropriate RF (or RF/DC) voltage signal to the ion guide electrodes 112, the ion guide electrodes 112 generate a linear (2D) ion trapping field along the length of the ion guide 104 that constrains ions of a certain m/z range to radial motions focused along the central axis 108, as generally represented by an ion-occupied region or ion cloud 122 in FIG. 1. The ion cloud 122 may be further compressed by damping the motions of the ions through collisions with an inert collision gas, which may be introduced into the interior space 120 from a gas source (not shown) by any suitable means.

Respective axial electrodes 126, 128 with apertures (or other suitable types of ion optics) may be provided at the respective first axial end 116 and the second axial end 118 of the ion guide 104 to prevent ions from escaping out from either the first axial end 116 or the second axial end 118. One or both axial electrodes 126, 128 may be utilized as an ion gate to control axial injection and/or ejection of ions. For these purposes, respective DC voltage sources 132, 134 may be connected to the axial electrodes 126, 128. As an example, parent ions may be injected through the first axial end 116, trapped by the ion guide electrodes 112, and dissociated into product ions. The product ions and remaining parent ions may then be ejected either back through the first axial end 116 or through the second axial end 118 for m/z analysis by an m/z analyzer located outside the ion guide 104. The axial motions of the ions may be controlled by generating an axial DC field between the axial electrodes 126, 128. An additional DC source or sources 136 may be connected to one or more of the ion guide electrodes 112 to modify the axial DC field as needed and/or to create radial DC fields as described further below.

The ECD apparatus 100 further includes an electron source 140. The electron source 140 includes an electron emitter and an electron control device, examples of which are described below. The electron source 140 is configured for directing a focused electron beam 142 into the interior space 120 of the ion guide 104 and into the ion cloud 122, along an electron beam direction that is radial (perpendicular) relative to the central axis 108. The electron source 140 is further configured such that the electron beam 142 constitutes a high electron flux, yet is decelerated such that the electrons upon reaching the ion cloud 122 have an energy low enough for ECD to occur effectively. The ion guide electrodes 112 may also be utilized to retard the electron beam 142 in a manner described below. The electron source 140, or both the electron source 140 and the ion guide electrodes 112, may be operated to limit the divergence of the electron beam 142 at the ECD site and ensure that low-energy electrons interact with the ions. The electron source 140 is further configured for enabling adjustment by a user of the electron energy in accordance with carrying out either ECD or hot ECD (HECD) as desired. Typically, electron energy ranges from 0-3 eV for ECD and from 3-20 for HECD.

In operation generally, target positive ions (preferably multiply charged) are introduced into the ECD apparatus 100 in any suitable manner. The ions are trapped and focused into an ion cloud 122 by the RF (or RF/DC) electrical field applied by the ion guide electrodes 112, and may be thermalized through interaction with a light molecular-weight collision gas. The electron source 140 is then operated to generate a high-flux electron beam 142, typically by thermionic emission. The electron source 140 is configured to implement a gating function (examples of which are described below) to transmit the electron beam 142 into the interior space 120 of the ion guide 104 for a predetermined period of time. In effect, the electron source 140 is configured to switch the electron beam 142 between ON and OFF states. The OFF state, however, does not necessarily require a condition in which no electrons are being generated, but rather may correspond to a condition in which the electrons are prevented from entering the interior space 120, due for example by the imposition of a negative voltage sufficient to reflect the electrons away from the ion guide 104. When the electron beam 142 reaches the ion cloud 122, the electrons have an opportunity to be captured by the positive ions, thereby releasing ionization energy sufficient to fragment the ions and produce product ions. After a sufficient period of time has elapsed for ECD (or HECD) to occur, the electron source 140 is operated to stop the influx of electrons into the interior space 120. The ion fragments and any non-dissociated parent ions are then removed from the ECD apparatus 100 by any suitable means and transmitted into a mass analyzer for further analysis.

Figure 2A:
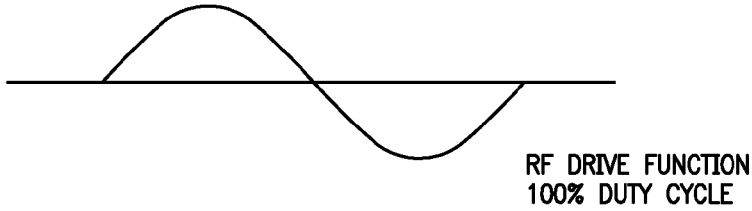
FIG. 2A is an illustration of an example of an RF ion trapping signal having a conventional sine wave form.
Figure 2B:
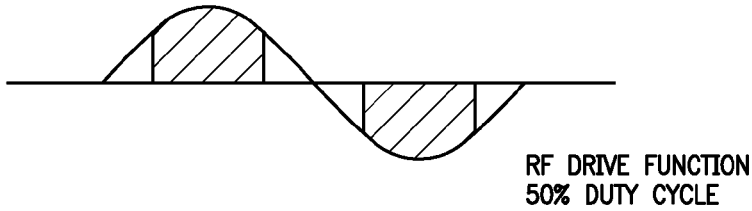
FIG. 2B is an illustration of an example of an RF ion trapping signal having a clipped sine wave form.

The electron source 140 may include control circuitry for synchronizing the timing of the electron beam 142 with the timing of the RF ion trapping signal applied by the ion guide electrodes 112. As appreciated by persons skilled in the art, for successful ECD to occur the electrons should be injected during periods of very low or zero RF voltage. A conventional RF ion trapping signal of the general form $V_{RF}\cos(\omega t)$ may be utilized for this purpose, as illustrated in FIG. 2A. It can be seen, however, that this basic sine wave shape provides very short periods of low or zero RF voltage. The periods of low or zero RF voltage may be extended by modifying the sinusoidal profile of the RF voltage (such as by clipping) or applying a train of non-sinusoidal voltage pulses that alternative between positive and negative amplitudes (e.g., square, rectangular, or sawtooth pulses). FIG. 2B illustrates an example of a clipped sine wave, in which the non-cross-hatched areas are in effect removed and correspond to periods of zero-magnitude RF voltage separated in time by periods of non-zero RF voltages. The operating parameters of a modified or pseudo sine wave are selected so as to be effective for trapping ions in the usual manner. The linear geometry of the ion guide 104 in conjunction with an RF voltage having an appropriately selected waveform enables ions to be trapped with low q (a well-known Mathieu trapping parameter), which is advantageous for fragmenting the ions via ECD.

FIG. 1 also schematically illustrates an example of a mass spectrometry (MS) system 160 of which the ECD apparatus 100 may form a part. The MS system 160 includes an ion source 162 that provides a beam 164 of ions for injection into the ECD apparatus 100. Any suitable design may be selected for the ion source 162, particularly an atmospheric-pressure (AP) type source such as, for example, an electrospray ionization (ESI) source, an AP chemical ionization (APCI) source, an AP photo-ionization source (APPI), or a matrix-assisted laser desorption ionization (MALDI) source. In typical implementations, an ESI source is preferred due to its ability to form multiply-charged ions (particularly doubly-charged ions) from a wide variety of large molecules such as proteins and peptides and without causing preliminary fragmentation. The MS system 160 may include an ion processing apparatus 166 between the ion source 162 and the ECD apparatus 100. The ion processing apparatus 166 may serve any number of functions. For instance, the ion processing apparatus 166 may serve as an RF-only ion guide for efficiently transporting ions as a focused beam 168 into the ECD apparatus 100. The ion processing apparatus 166 may be configured as a mass filter, or as a 2D or 3D ion trap, for isolating ions of a selected mass or mass range prior to injection into the ECD apparatus 100. The ion processing apparatus 166 may also serve as a collision cell for fragmenting parent ions into product ions by CID or IRMPD. In this case, the product ions may then be injected into the ECD apparatus 100 and fragmented further by ECD into smaller ions (e.g., granddaughter ions) for subsequent m/z analysis. The ion processing apparatus 166 may initially serve as an ion guide for directing a focused beam 168 of parent ions into the ECD apparatus 100. Once the parent ions are fragmented into product ions by ECD, the product ions may then be ejected back into the ion processing apparatus 166 via the first axial end 116. The ion processing apparatus 166 may then be operated as an m/z analyzer, with scanned product ions being ejected to a suitable ion detector (not shown). Alternatively, the ECD apparatus 100 may eject product ions 172 through the second axial end 118 to an m/z analyzer 174, which in turn transmits the current (or image) 176 of mass-sorted ions to a detector 178 and associated data-acquisition electronics. Any type of mass analyzer 174 may be used, such as for example an ion trap, mass filter, time-of-flight (TOF) instrument, FTMS, magnetic sector instrument, electrostatic analyzer (ESA), etc. The detector 178 may be integrated with the mass analyzer 174, depending on design.

FIG. 3 is a perspective view of a more detailed example of an ECD apparatus 300 provided in accordance with the present disclosure, and FIG. 4 is a cross-sectional view of the ECD apparatus 300 in the transverse plane perpendicular to the central axis. The ECD apparatus 300 includes an ion guide 304 and an electron source 340. In this example, the ion guide 304 is based on a hexapole electrode arrangement (six ion guide electrodes 312). The ion guide electrodes 312 are depicted as cylindrical rods as a typical implementation, although it will be understood that the ion guide electrodes 312 may have other shapes. As schematically illustrated in FIG. 4, alternate rods 312 are electrically interconnected and placed in signal communication with an appropriate RF voltage source 438. The ion guide electrodes 312 are driven by an RF voltage typically operating from about 500 kHz to about 5 MHz. The RF voltage applied to one set of interconnected ion guide electrodes 312 is 180 degrees out of phase from the RF voltage applied to the other set of interconnected ion guide electrodes 312. In some implementations, a DC voltage may be superposed on the applied RF voltage to modify the ion trapping parameters, in which case the RF voltage source 438 may be considered as schematically representing a composite RF/DC voltage source. In addition to radial confinement of the ions by the applied RF trapping field, the ions may be confined in the axial direction by applying DC potentials to axial end-positioned lenses 126, 128 as discussed above (FIG. 1).

In the example given in FIGS. 3 and 4, the electron source 340 includes an electron emitter 344 and an electron control device formed by various electrically conductive elements (surfaces, electrodes, lenses, or the like) utilized to focus and direct an electron beam with controlled electron kinetic energy. As a general matter, the electron emitter 344 may be any device that can provide a source of electrons adequate for ECD-related operations, such as a filament composed of a thermionic material (e.g., tungsten, various ceramics), an electron gun, etc. The electrically conductive elements are designed and positioned so as to create an accelerating electrical field sufficient to produce a beam of electrons emitted from the electron emitter 344 and a decelerating electrical field sufficient to reduce electron energy to levels effective for ECD or HECD. In the illustrated example, the electrically conductive elements include a reflector 346 positioned on the side of the electron emitter 344 opposite to the ion guide 304, a first electron guide electrode 348 interposed between the electron emitter 344 and the ion guide 304, and a second electron guide electrode 352 interposed between the first electron guide electrode 348 and the ion guide 304. The first electron guide electrode 348 and the second electron guide electrode 352 have respective apertures 354, 356 aligned with the radial axis or plane along which the electron beam is directed into the ion guide 304. Additionally, a pair of guard electrodes 358 may be interposed between the second electron guide electrode 352 and the respective top two ion guide electrodes 312. The guard electrodes 358 may be physically separate components with a gap 362 between them aligned with the apertures 354, 358 of the first electron guide electrode 348 and the second electron guide electrode 352. Alternatively, the guard electrodes 358 may be two conductive regions of a single conductive element having an aperture in the place of the gap 362. To control the electron beam, the reflector 346, first electron guide electrode 348, second electron guide electrode 352, and guard electrodes 358, and some or all of the ion guide electrodes 312 may be individually energized with DC potentials via communication with DC voltage sources (not specifically shown).

In the example illustrated in FIGS. 3 and 4, the electron emitter 344 is elongated along the central axis in the same manner as the ion guide electrodes 312. Accordingly, the respective apertures 354, 356 of the first electron guide electrode 348 and the second electron guide electrode 352 are similarly elongated. Taking the length of the ion guide 304 (and thus the interior space thereof) as generally being the axial length from the first axial end to the second axial end of the ion guide electrodes 312, in some implementations the electron emitter 344 and the lens apertures 354, 356 extend over at least a majority of the length of the ion guide 304, meaning greater than 50% of the length of the ion guide 304. In other implementations, the electron emitter 344 and the lens apertures 354, 356 may extend up to (or substantially over) the entire length of the ion guide 304. The use of an elongated electron emitter 344 takes advantage of the elongated ion cloud 122 (FIG. 1) that forms in the linear-geometry ion guide 304. The electron source 340 in this case generates an electron beam in the form of a sheet or curtain that irradiates up to the entire length of the interior space of the ion guide 304, thereby significantly increasing the effectiveness of ECD-induced fragmentation of the trapped ions.

Figure 5A:
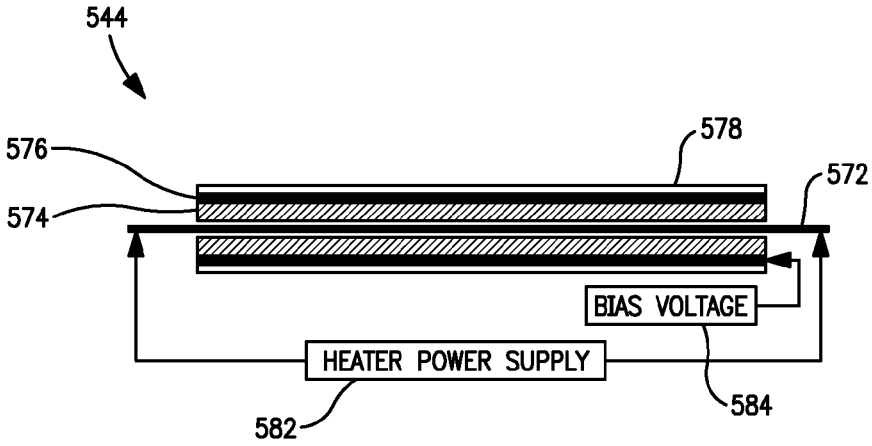
FIG. 5A is a cross-sectional lengthwise view of an indirectly heated electron emitter provided in accordance with the present disclosure.
Figure 5B:
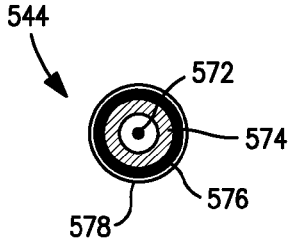
FIG. 5B is a cross-sectional transverse view of the electron emitter illustrated in FIG. 5A.

When forming an electron beam from a heated surface, it is important not to add an additional energy spread to the electrons by having a voltage drop along the length of an electron emitter, such as would be the case if the electron-emitting surface were directly heated by passing a current though as is conventionally done with a filament-type electron emitter. A more advantageous electron emitter is illustrated by example in FIG. 5. Specifically, FIG. 5A is a cross-sectional lengthwise view of an indirectly heated electron emitter 544, and FIG. 5B is a cross-sectional transverse view of this electron emitter 544. The electron emitter 544 includes a centrally-positioned filament or wire 572, a layer 574 of electrically insulating material coaxially surrounding the wire 572, a layer 576 of electrically conductive material coaxially surrounding the insulating layer 574, and a layer 578 of a thermionic-emissive material coaxially surrounding the conductive layer 576. The wire 572 is utilized for heating and thus is connected to a heater power supply 582. The wire 572 may be composed of any electrically conductive material suitable for resistive heating, such as for example, tungsten, iridium, or other materials. The heater current that is passed through the wire 572 will be associated with a voltage drop typically of several volts from one end of the wire 572 to the other. The insulating layer 574 and the conductive layer 576 are interposed between the wire 572 and the thermionic-emissive material 578 to isolate this voltage drop from the thermionic-emissive material 576. The insulating layer 574 may be composed of any material suitable for use as an electrical insulator, such as various refractory materials. The conductive layer 576 is generally a metal film preferably having a composition that enables it to bind to the insulating layer 574 as a coating via a suitable fabrication technique, such as for example molybdenum. The conductive layer 576 is connected to a DC voltage source 584 to clamp the conductive layer 576 to a fixed voltage. As no current flows through the conductive layer 576, all points on its surface will be at the same voltage potential such that the conductive layer 576 serves as a guard electrode between the energized wire 572 and the thermionic-emissive material 578 and thereby prevents a voltage drop across the length of the thermionic-emissive material 578. The thermionic-emissive material 578 is preferably composed of a material that can be easily formed on the conductive layer 576 as a coating. Preferably, the thermionic-emissive material 578 is composed of a low-work function material that emits electrons at a low temperature, examples of which include but are not limited to ceramic oxides such as thoria ($ThO_2$), yttria ($Y_2O_3$), or the like. The composite electron emitter 544 illustrated in FIG. 5 may be utilized as the electron emitter in any of the implementations disclosed herein.

Referring back to FIG. 4, in operation electrons are emitted from the heated surface of the electron emitter 344 and accelerated towards the first electron guide electrode 348 by an electrical field formed by DC voltages applied to the reflector 346 and the first electron guide electrode 348. The magnitude of this DC field must be great enough to extract electrons from the electron emitter 344. At this stage, however, the energy of the liberated electrons is too great for ECD and must be reduced. Thus, the high-energy electrons exiting the aperture 354 of the first electron guide electrode 348 are decelerated and focused into the interior space of the ion guide 304 by an electrical field formed by a DC voltage applied to the second electron guide electrode 352 (and DC voltages applied to the guard electrodes 358 if provided). To slow down the electrons further, an additional decelerating or retarding field may be formed within the ion guide 304 by applying DC voltages to at least some of the ion guide electrodes 312. Thus, decelerating DC fields are formed both outside and inside the ion guide 304 in this implementation. Stated in another way, a DC field effective to decelerate the electron beam may extend from the first electron guide electrode 348 to a selected point within the interior space of the ion guide 304. The extent to which the DC retarding field penetrates the interior space of the ion guide 304 may be controlled by selecting which ion guide electrodes 312 are energized by the DC voltages, and the strength of the retarding field may be controlled by adjusting the magnitudes of the DC voltages applied to the selected ion guide electrodes 312. It should be evident that the various DC accelerating and decelerating fields are oriented in the radial direction whereby the electron beam is focused and directed along this radial direction into the ion guide 304 and toward the ion cloud maintained in the vicinity of the central axis. For electron beam injection into the ion guide 304, a non-limiting example of the various DC voltages applied for the purpose of controlling the electron beam is as follows: reflector 346 (−2 V), electron emitter 344 (0 V), first electron guide electrode 348 (70 V), second electron guide electrode 352 (25 V), guard electrodes 358 (10 V), uppermost two ion guide electrodes 312 (4 V), middle two ion guide electrodes 312 (1 V), and lowermost two ion guide electrodes 312 (0 V). More generally, the DC voltages applied to various conductive surfaces are such that the electrons passing between the two uppermost ion guide electrodes 312 (and the two guard electrodes 358, if provided) will have typical energies of 30-50 eV.

The guard electrodes 358 may be provided for at least two purposes. The first is to provide focusing of the electron beam to reduce transverse spreading of the beam as it decelerates. The second is to shield the second electron guide electrode 352 from the effects of capacitive coupling of the RF energy propagated by the ion guide rods 312 into the voltage supply connected to the second electron guide electrode 352. For this purpose, the guard electrodes 358 may be shaped so as to conform to the shape of the upper two ion guide electrodes 312, such that the guard electrodes 358 cover the portion of the outer surface of the upper two ion guide electrodes 312 generally facing the second electron guide electrode 352 as well as effectively forming a lens-type aperture at the gap 362 between these two ion guide electrodes 312. In the illustrated example in which the ion guide electrodes 312 are cylindrical rods, the guard electrodes 358 have semi-circular shapes covering roughly half of the outer surface area of the corresponding ion guide electrodes 312. Because the guard electrodes 358 prevent the RF voltage from being induced into the second electron guide electrode 352 by capacitive coupling, a large amount of electrical filtering is not required to protect the voltage source of the second electron guide electrode 352 from the effects of the RF voltage. Therefore, the voltage response time can be very fast and the second electron guide electrode 352 can be utilized as a gate electrode to control the passage of electrons into the trapping region of the ion guide 304 and quickly start and stop the electron capture process. To close the gate, a negative voltage may be applied to the second electron guide electrode 352 that is greater than the voltage applied to the first electron guide electrode 348, whereby electrons will be reflected away from the trapping region. At a normal positive voltage (e.g., 10-40 V) applied to the second electron guide electrode 352, the electrons will pass through its aperture 356 and enter the trapping region.

The ion guide 304 is configured such that it may also be utilized as an electron gate. As described earlier, the ion guide electrodes 312 are arranged lengthwise along (and typically parallel to) the central axis and at radial distances therefrom. In the plane perpendicular to the central axis, the ion guide electrodes 312 are circumferentially spaced from each other. When the RF trapping field is applied, each ion guide electrode 312 is driven by an alternating voltage that is 180 degrees out-of-phase with the alternating voltage driving the adjacent ion guide electrodes 312 located on either side of that ion guide electrode 312. This means that over a portion of the RF cycle (typically 50% of the time or more depending on the type of RF trapping signal being implemented), the potential difference across the gap between any two adjacent ion guide electrodes 312 is large enough to deflect electrons in a direction transverse to the radial direction along which the electron beam is directed in the implementations taught herein. Thus, according to an implementation of the present disclosure, the two adjacent ion guide electrodes 312 between which the electron beam is directed may serve as an electron gate. During periods of zero or near-zero RF voltage, the electron beam easily penetrates between the two adjacent ion guide electrodes 312 without impairment and is directed and focused along the radial electron beam direction as described earlier. During periods of appreciable non-zero RF voltage, the electron beam is deflected away from radial electron beam direction without entering the interior space of the ion guide 304, and thus there is no concern with high-energy electrons reaching the ion trapping region. The foregoing method of gating the electron beam is particularly useful in conjunction with an RF trapping voltage that comprises distinct pulses with substantially abrupt transitions between zero and non-zero amplitude levels, as in the case illustrated in FIG. 2B.

Figure 6:
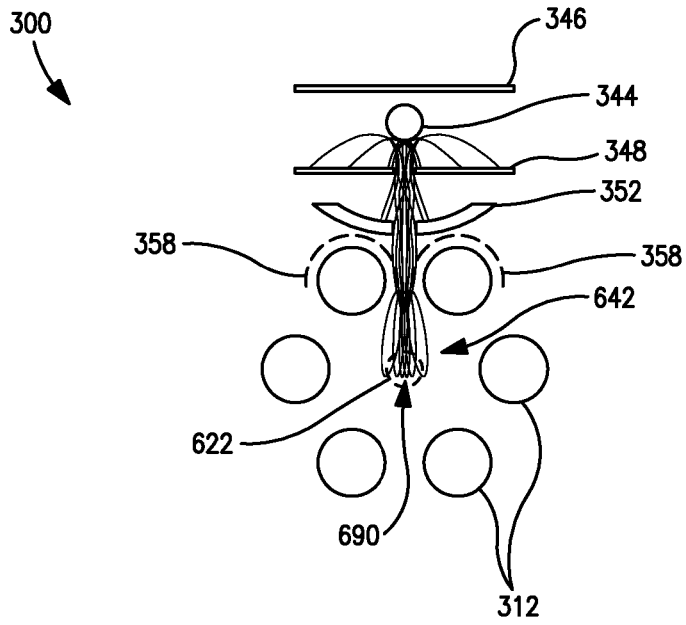
FIG. 6 is a cross-sectional view of the ECD apparatus in the transverse plane perpendicular to the central axis similar to FIG. 4 but additionally showing electron trajectories calculated by an ion simulation program.
Figure 7:
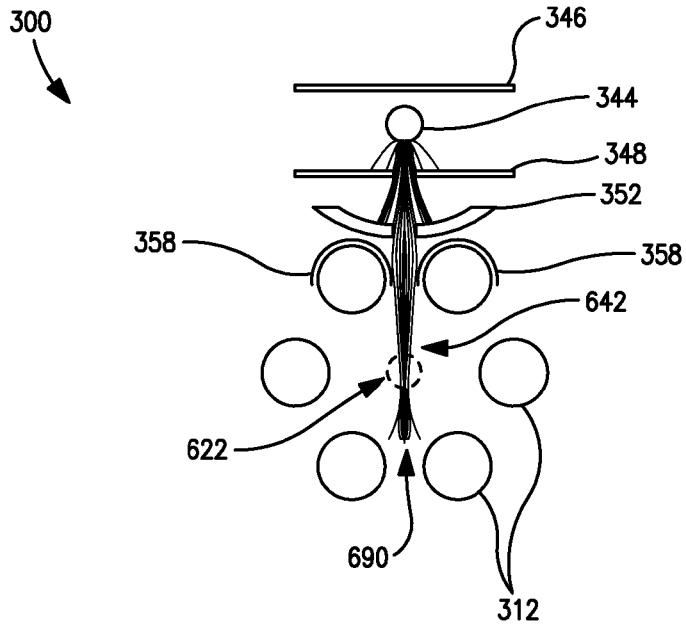
FIG. 7 is a cross-sectional view of the ECD apparatus similar to FIG. 6 but showing electron trajectories with a different turning point.

FIG. 6 is a cross-sectional view of the ECD apparatus 300 in the transverse plane perpendicular to the central axis similar to FIG. 4 but additionally showing electron trajectories 642 calculated by the commercially available SIMION® ion simulation program (Scientific Instrument Services, Inc., Ringoes, N.J.). As the electrons continue to decelerate in the DC retarding field established by the DC voltages applied to the ion guide electrodes 312, the electrons will reach a point 690 at which they have stopped and turned around their motion. At this turning point 690 the electrons have energies (and velocities) close to zero. The only remaining appreciable electron energy will be in the transverse direction, i.e., in the horizontal direction from the perspective of FIG. 6. Hence, as previously noted it is important to limit the spatial spread of the electron beam 642 as it is decelerated by keeping the electron beam 642 as parallel (non-diverging) as possible. The total kinetic energy ($E=mv^2/2$) of an electron in the electron beam 642 is the sum of its energy in the radial direction of the electron beam 642 and in the transverse direction. Electron capture by an ion in the trapping center or ion cloud 622 requires that the total kinetic energy be low (within the ranges specified earlier for ECD or HECD). The ideal condition for electron capture corresponds to the turning point 690, with the total kinetic energy of each electron being in the low range. If the trajectories of the electrons are not parallel in the radial electron beam direction, then their velocity (and energy) in the radial direction will reach zero at the turning point 690 but their total energy will not be zero, because there will still be a non-zero velocity (and energy) component in the transverse direction. In accordance with the present teachings, the lens action of the second electron guide electrode 352 and the guard electrodes 358, and the decelerating fields provided by these components as well as by the ion guide electrodes 312, provide sufficient electron beam convergence to ensure that the residual transverse energy is small and within the range required for ECD or HECD. The turning point 690 of the electron motion may be adjusted by adjusting the DC voltages applied to the ion guide electrodes 312. For example, the retarding DC voltages may be set so as to locate the turning point 690 on the central axis of the ion guide 304 where the target ions are confined (i.e., a trapping center or ion cloud 622), as shown in FIG. 6. Alternatively, the retarding DC voltages may be reduced so as to move the turning point 690 further past the central axis, as shown in FIG. 7. In this manner, the energy of the electrons as they pass through the region 622 of the central axis is increased. It thus can be seen that the electron energy made available for interaction with the ions may be controlled by controlling the location of the turning point 690. This may be useful, for example, when it is desired to adjust the electron energy upwards for HECD.

Figure 8:
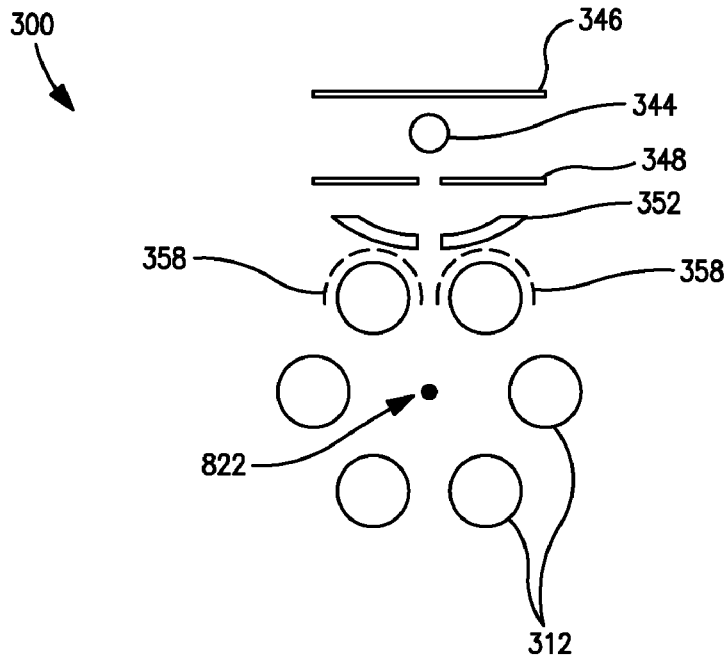
FIG. 8 is a cross-sectional view of the ECD apparatus similar to FIG. 4 but additionally shown an ensemble of trapped ions.
Figure 9:
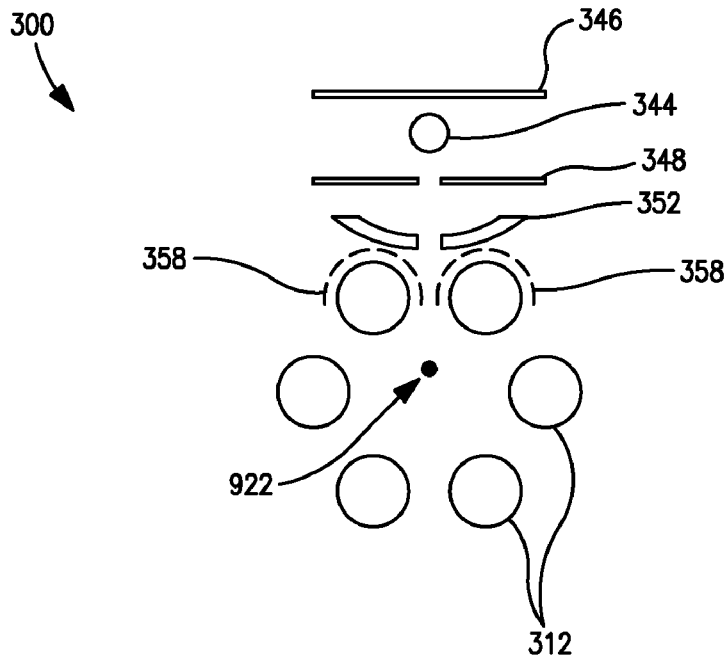
FIG. 9 is a cross-sectional view of the ECD apparatus similar to FIG. 8, in which the trapping conditions are the same but the ion mass is different.

As described earlier in this disclosure, the target ions may be successfully trapped with the use of the typical sine-wave RF voltage signal illustrated in FIG. 2A, or alternatively by clipping the sine wave to a form such as shown in FIG. 2B, or by applying an equivalent or similar series of alternating positive and negative RF pulses not based on a sinusoidal waveform. A clipped or pulsed waveform can be effective for trapping ions over a broad mass range, as further taught by Zerega et al. and Sadat et al., cited above. FIGS. 8 and 9 are cross-sectional views of the ECD apparatus 300 in the transverse plane perpendicular to the central axis, with ion simulations produced by the SIMION® software application. In FIG. 8, ions 822 of m/z=100 are trapped in a hexapole trapping field driven by a 1-MHz RF voltage with a 50% duty cycle as shown in FIG. 2B. In FIG. 9, ions 922 of m/z=1000 are trapped under the same conditions. In both FIGS. 8 and 9, a DC offset voltage is superposed on the RF trapping field. It will be noted that this DC offset voltage is separate from the DC voltages utilized to control the electron beam and any DC voltage utilized to apply an axial DC field. It is known that a DC field superposed on the RF trapping field will cause ions to be displaced from the central axis along the direction of the dipole associated with this DC field. Ions with increasing m/z ratios will have decreasing trapping potentials and therefore will be displaced further from the central axis, as seen by comparing FIGS. 8 and 9. Because the turning point of the electrons can be adjusted by changing the kinetic energy of the electrons that pass through the guard electrodes 358 and/or by adjusting the DC retarding voltages applied to the ion guide electrodes 312 as described above, the turning point can be made to coincide with the location of the target ions, whether on the central axis (FIG. 6) or offset from the central axis (FIGS. 8 and 9).

According to additional implementations, means are provided for increasing the internal energy of the target ions to modify the fragmentation process that occurs when the target ions undergo ECD or HECD in the ion guide, such as for enabling additional bonds of the target ions to be broken beyond those broken by the electron capture process alone. Such means may be utilized to increase the target ions' internal energy prior to, during, or after the electron capture process. In some implementations, an axial DC field is impressed across the length of the ion guide to accelerate the ions and periodically or aperiodically reverse the direction of the ions. The effect of the axial DC field is to increase the axial kinetic energy of the ions. The kinetic energy is converted into internal energy as a result of the ions colliding with a light collision gas such as, for example, helium. The amplitude of the axial DC field at the axial ends of the ion guide, or additionally at one or more points along the central axis between the axial ends, may be adjusted so as to control the axial kinetic energy of the ions. Ions in a linear RF trap do not have a natural axial oscillation due to the RF trapping field being applied because the RF trapping field is transverse to the central axis. Therefore, an axial field can increase the kinetic energy of the ions without the need to be at a frequency that is in resonance with any secular frequency of ion motion (unlike the conventional technique of increasing ion energy via a supplemental AC field as is done for CID), and thus a very low-frequency axial field may be employed. Increasing the kinetic energy only along the axis also provides improved control of the electron energy at the point where the ions and electrons intersect and electron capture occurs.

Referring to FIG. 1, a controllable axial DC field may be implemented with the use of DC voltage sources 132, 134 communicating with the axial end electrodes 126, 128 of the ion guide 104, and optionally with DC voltage sources 136 communicating with the ion guide electrodes 112. As another example, additional elongated electrodes (not shown) may be located between the ion guide electrodes 112 (and outside the interior space 120) to which DC voltages may be applied. To impress a voltage gradient along the central axis 108, such additional elongated electrodes may be tilted at an angle with respect to the central axis 108, or configured so as to have a varying electrical resistance along the axial direction, etc. The use of additional elongated electrodes may be less preferred in some applications due to the fact that relatively high DC voltages are typically required to ensure the DC field penetrates to the central axis 108 where the target ions are located.

Figure 10:
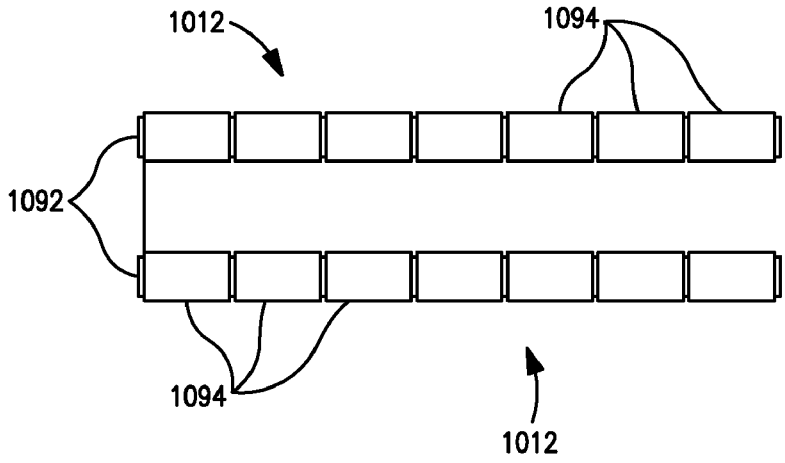
FIG. 10 is a side (lengthwise) view of an example of a set of ion guide electrodes configured for applying an axial DC field in accordance with the present disclosure.

A yet further alternative embodiment advantageous for many applications is illustrated in FIG. 10, which is a lengthwise view of a set of ion guide electrodes 1012 configured for applying an axial DC field. For simplicity only two ion guide electrodes 1012 are shown, although it will be understood that the ion guide electrodes of any ECD apparatus disclosed herein may be configured in accordance with the example illustrated in FIG. 10. Each ion guide electrode 1012 is configured so as to contain a series of axially spaced electrically conductive segments that are electrically isolated from each other. In the illustrated example, each ion guide electrode 1012 is formed from insulating rods 1092 that are coated with axially spaced conductive (e.g., metal) bands 1094. DC voltage sources (not shown) may be placed in signal communication with each band 1094 whereby the DC voltage on each individual band 1094 is adjustable. This configuration enables the generation of an axial DC field with a highly controllable axial voltage gradient. In addition to increasing the internal energy of ions, the axial DC field may also be utilized to transport ions out from the ion guide to other devices located before or after the ion guide.

Another alternative to the example shown in FIG. 10 is to divide the ion guide electrodes into physically distinct axial segments separated by gaps, so long as inhomogeneous fields in the regions of the gaps do not interfere with the injection and control of a focused electron beam and the electron capture process as taught herein.

Figure 11:
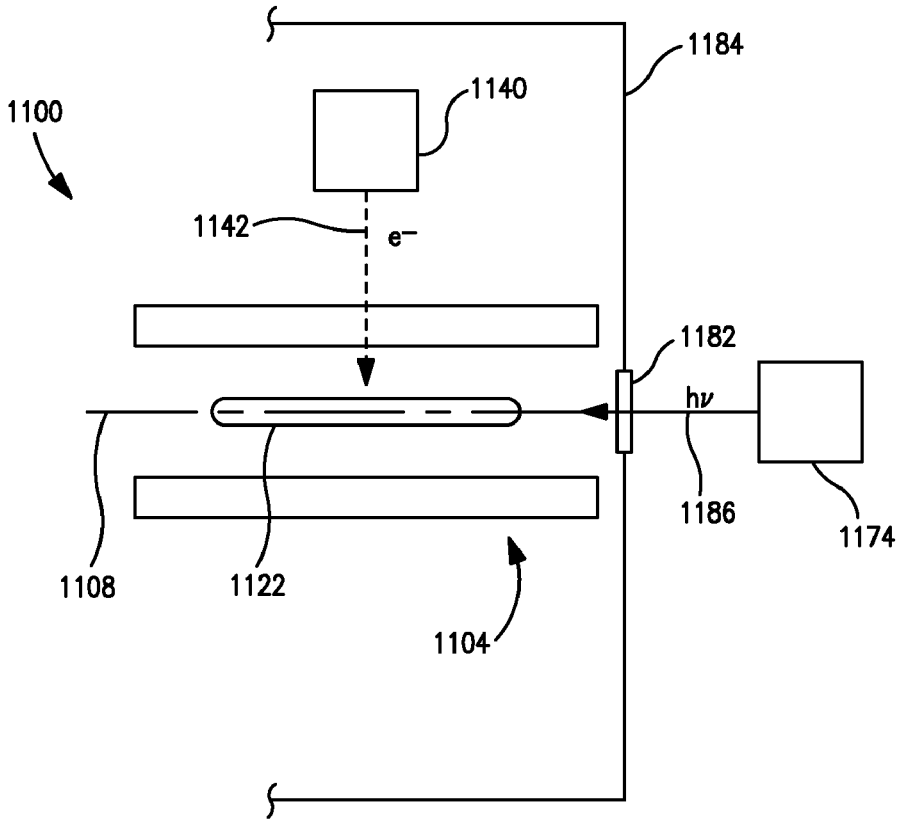
FIG. 11 is a schematic side (lengthwise) view of an example of an ECD apparatus and a photon source provided in accordance with the present disclosure.

Another means for increasing the internal energy of target ions is schematically illustrated in FIG. 11, which is a side (lengthwise) view of an ECD apparatus 1100 with a linear multipole ion guide 1104 and a photon source 1174 such as a tunable IR laser. Ions are trapped in a confined volume 1122 in the ECD apparatus 1100 along a central axis 1108 and irradiated by electrons 1142 from an electron source 1140 as described above. The ECD apparatus 1100 includes a photon-transmitting (e.g., IR) window 1182 supported by a housing or other structure 1184. The photon source 1174 is optically aligned with the window 1182 and the central axis 1108 and hence also with the trapped ions. Accordingly, the photon source 1174 directs a photon beam 1186 along the central axis 1108 to easily irradiate the ions. Absorption of photons by the ions increases their internal energy. Irradiation by the photon beam 1186 may occur prior to, during or after irradiation by the electron beam 1142. The off-axis positioning of the electron beam 1142 as taught herein leaves the axial ends of the ion guide 1104 available for coaxial positioning of the photon source 1174 or other devices such as shown in FIG. 1. On-axis photon irradiation helps to ensure complete irradiation of the entire ensemble of trapped ions. Alternatively, the photon source 1174 may be located off-axis at some angle relative to the central axis.

It will be understood that the methods and apparatus described in the present disclosure may be implemented in an ion processing system such as an MS system as generally described above by way of example. The present subject matter, however, is not limited to the specific ion processing systems illustrated herein or to the specific arrangement of circuitry and components illustrated herein. Moreover, the present subject matter is not limited to MS-based applications, as previously noted.

As used herein, the term "electron capture dissociation" (or "ECD") encompasses the term "hot electron capture dissociation" (or "HECD") unless specified otherwise.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An electron capture dissociation apparatus, comprising:

a first axial end;

a second axial end disposed at a distance from the first axial end along a central axis;

a plurality of ion guide electrodes arranged along the central axis from the first axial end to the second axial end, the ion guide electrodes spaced circumferentially from each other about the central axis and disposed at a radial distance in a transverse plane orthogonal to the central axis, wherein the ion guide electrodes circumscribe an ion guide interior space extending along the central axis from the first axial end to the second axial end;

an electron emitter disposed outside the ion guide interior space; and an electron control device configured for focusing an electron beam from the electron emitter toward the central axis, along a radial electron beam direction between two of the ion guide electrodes and axially between the first axial end and the second axial end, and for decelerating the electron beam in a DC decelerating field of adjustable voltage potential directed along the electron beam direction.

2. The electron capture dissociation apparatus of claim 1, further comprising means for applying an RF trapping voltage signal to the ion guide electrodes to generate a two-dimensional ion trapping field in the ion guide interior space, wherein the RF trapping voltage signal comprises alternating positive and negative impulses temporally separated by periods of zero RF voltage.

3. The electron capture dissociation apparatus of claim 2, further comprising means for applying a DC retarding field of adjustable voltage potential to the ion guide electrodes along the electron beam direction to decelerate the electron beam in the ion guide interior space.

4. The electron capture dissociation apparatus of claim 1, further comprising means for increasing internal energy of ions in the ion guide interior space, wherein the means for increasing internal energy is selected from the group consisting of means for applying a DC axial field along the central axis between the first axial end and the second axial end to increase ion kinetic energy in the axial direction, and a photon source positioned for directing a photon beam into the ion guide interior space.

5. The electron capture dissociation apparatus of claim 1, wherein the electron control device comprises a first electron guide electrode interposed between the electron emitter and the plurality of ion guide electrodes and a second electron guide electrode interposed between the first electron guide electrode and the plurality of ion guide electrodes, the first electron guide electrode and the second electron guide electrode having respective apertures aligned along the electron beam direction.

6. The electron capture dissociation apparatus of claim 5, further comprising means for accelerating electrons in the electron beam between the electron emitter and the first electron guide electrode, and means for decelerating electrons in the electron beam between the first electron guide electrode and the second electron guide electrode.

7. The electron capture dissociation apparatus of claim 5, wherein the electron control device further comprises a pair of guard electrodes respectively interposed between the second electron guide electrode and the two ion guide electrodes between which the electron beam is focused.

8. The electron capture dissociation apparatus of claim 7, further comprising means for accelerating electrons in the electron beam between the electron emitter and the first electron guide electrode, and means for decelerating electrons in the electron beam between the first electron guide electrode and the guard electrodes.

9. The electron capture dissociation apparatus of claim 5, wherein the plurality of ion guide electrodes have an ion guide electrode length extending from the first axial end to the second axial end, the electron emitter comprises an electron emitting surface extending along the central axis over a majority of the ion guide electrode length, and the respective apertures of the first electron guide electrode and the second electron guide electrode are elongated over a majority of the ion guide electrode length.

10. A method for fragmenting a parent ion into a product ion by electron capture dissociation in a linear multipole ion guide, the method comprising:

applying an RF trapping voltage to a plurality of ion guide electrodes of the ion guide, the ion guide electrodes arranged along a central axis from a first axial end to a second axial end and circumscribing an ion guide interior space, wherein applying the RF trapping voltage confines the parent ion to an ion trapping region located along the central axis;

directing an electron beam from an electron emitter outside the ion guide to the ion trapping region along an electron beam direction that is radial to the central axis and passes through a gap between two adjacent ion guide electrodes; and decelerating electrons of the electron beam by applying a DC decelerating field between a point outside the ion guide interior space to a point inside the interior space and oriented along the electron beam direction, wherein the electrons reach the ion trapping region at a reduced electron energy sufficient for electron capture by the parent ion to occur.

11. The method of claim 10, wherein applying the DC decelerating field comprises applying a DC voltage of a first magnitude to a first electron guide electrode interposed between the electron emitter and the ion guide, and applying a DC voltage of a second magnitude less than the first magnitude to a second electron guide electrode interposed between the first electron guide electrode and the ion guide.

12. The method of claim 10, wherein applying the DC decelerating field comprises applying a DC voltage of a first magnitude to an electron guide electrode interposed between the electron emitter and the ion guide, and applying a DC voltage of a second magnitude less than the first magnitude to a pair of guard electrodes interposed between the first electron guide electrode and the respective two adjacent ion guide electrodes, the pair of electrodes forming a gap through which the electron beam is directed.

13. The method of claim 12, further comprising reducing a spatial spread of the electron beam by adjusting the DC voltage applied to the guard electrodes.

14. The method of claim 10, wherein applying the DC decelerating field comprises applying a first DC voltage to an electron guide electrode interposed between the electron emitter and the ion guide, and applying one or more additional DC voltages of a lesser magnitude than the first DC voltage to two or more of the ion guide electrodes.

15. The method of claim 14, wherein the electron beam has a turning point in the ion guide interior space at which the electrons reverse direction, and further comprising adjusting the location of the turning point by adjusting one or more of the DC voltages applied to the ion guide electrodes.

16. The method of claim 10, wherein applying the DC decelerating field comprises applying a DC voltage of a first magnitude to a first electron guide electrode interposed between the electron emitter and the ion guide, and applying a DC voltage of a second magnitude less than the first magnitude to a second electron guide electrode interposed between the first electron guide electrode and the ion guide, and further comprising gating the electron beam by adjusting the DC voltage applied to the second electron guide electrode, and shielding the second electron guide electrode from the RF trapping voltage by positioning a pair of guard electrodes interposed between the second electron guide electrode and the respective two adjacent ion guide electrodes, the pair of electrodes forming a gap through which the electron beam is directed.

17. The method of claim 10, further comprising gating the electron beam by applying the RF trapping voltage to the two adjacent ion guide electrodes such that the RF trapping voltage applied to one of the adjacent ion guide electrodes is 180 degrees out-of-phase with the RF trapping voltage applied to other ion guide electrode, wherein over a first period of the RF trapping voltage the electron beam is deflected away from the ion guide by a potential difference across the gap between the two adjacent ion guide electrodes and over a second first period of the RF trapping voltage the electron beam penetrates into the ion guide.

18. The method of claim 10, wherein the RF trapping voltage applied comprises a series of pulses of non-zero voltage magnitudes of alternating polarities temporally separated by periods of zero voltage magnitudes, and further comprising directing the electron beam to the trapping region substantially during a period of zero voltage magnitude.

19. The method of claim 10, further comprising increasing an internal energy of the parent ion by accelerating the parent ion through an axial DC field in the presence of a gas, or by irradiating the parent ion with a photon beam.

20. The method of claim 10, wherein the electron emitter extends along the central axis, and directing the electron beam comprises irradiating the ion guide interior space over a majority of an axial length of the ion guide.

* * * * *

UNITED STATES PATENT AND TRADEMARK OFFICE

CERTIFICATE OF CORRECTION

PATENT NO. : 8,158,934 B2
APPLICATION NO. : 12/547358
DATED : April 17, 2012
INVENTOR(S) : Gregory J. Wells It is certified that error appears in the above-identified patent and that said Letters Patent is hereby corrected as shown below:

In column 16, line 41, in Claim 3, delete "claim 2," and insert -- claim 1, --, therefor.

Signed and Sealed this
Fourth Day of September, 2012

David J. Kappos

David J. Kappos
*Director of the United States Patent and Trademark Office*